US007596868B2

(12) United States Patent
Berns

(10) Patent No.: US 7,596,868 B2
(45) **Date of Patent: *Oct. 6, 2009**

(54) KNIFE

(75) Inventor: Harald Berns, Wuppertal (DE)

(73) Assignee: Martor KG, Solingen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/312,623

(22) Filed: Dec. 20, 2005

(65) Prior Publication Data

US 2006/0130339 A1 Jun. 22, 2006

(30) Foreign Application Priority Data

Dec. 22, 2004 (DE) ..... 10 2004 063 046

(51) Int. Cl.
*B26B 1/08* (2006.01)

(52) U.S. Cl. ..... 30/162; 30/2

(58) Field of Classification Search ..... 30/2, 30/162, 329, 335, 339, 164
See application file for complete search history.

(56) References Cited

U.S. PATENT DOCUMENTS 4,683,656 A * 8/1987 Peyrot et al. ..... 30/162
6,148,520 A * 11/2000 Berns ..... 30/2
6,550,144 B1 * 4/2003 Berns ..... 30/162
6,553,673 B2 * 4/2003 Peyrot et al. ..... 30/162
6,775,911 B2 * 8/2004 Tremblay ..... 30/162
6,785,966 B2 * 9/2004 Berns ..... 30/2

FOREIGN PATENT DOCUMENTS

DE 43 15 495 * 11/1994

* cited by examiner

*Primary Examiner*—Hwei-Siu C Payer
(74) *Attorney, Agent, or Firm*—Wildman, Harrold, Allen & Dixon LLP

(57) ABSTRACT

The present blade device invention comprises an elongated housing wherein the housing comprises forward and rearward end portions and wherein the forward end portion defines an opening. The invention further comprises a blade holder moveable along a length of the housing toward the forward end portion and an actuator moveable along the length of the housing toward the forward end portion wherein the actuator is associated with the blade holder to impart movement to the blade holder toward the forward end portion of the housing. The invention further comprises a projection secured to one of the blade holder and the actuator wherein the projection extends in a direction transverse to the length, wherein the projection comprises a control surface which extends in a direction nonparallel to the length, wherein the other of the actuator and the blade holder to which the projection is not secured contacts the control surface and wherein the blade holder is movable in the direction nonparallel to the length.

16 Claims, 5 Drawing Sheets

10
22
35
29
z
18
S
30
20
32
21
19
14
15
GV
17
23
13
GK
-16-
26
11
GE
12
28
24
P
33
H
42
34
31
25
27
x 10
22
35
29
z
36
25
37
SF
34
42
18
32
30
31
S
20
P
27
24
28
21
19
26
14
GE
15
GV
12
11
17
-16-
GK
23
13
x

KNIFE

RELATED APPLICATION

Foreign Application Priority Data:

Filed Dec. 22, 2004 [DE] Germany DE 10 2004 063 046.1.

FIELD OF THE INVENTION

This invention relates to a blade holding device and more particularly a blade holding device wherein the blade is extendable and retractable.

SUMMARY OF THE INVENTION

The present blade device invention comprises an elongated housing wherein the housing comprises forward and rearward end portions and wherein the forward end portion defines an opening. The invention further comprises a blade holder moveable along a length of the housing toward the forward end portion and an actuator moveable along the length of the housing toward the forward end portion wherein the actuator is associated with the blade holder to impart movement to the blade holder toward the forward end portion of the housing. The invention further comprises a projection secured to one of the blade holder and the actuator wherein the projection extends in a direction transverse to the length, wherein the projection comprises a control surface which extends in a direction nonparallel to the length, wherein the other of the actuator and the blade holder to which the projection is not secured contacts the control surface and wherein the blade holder is movable in the direction nonparallel to the length.

DETAILED DESCRIPTION OF THE INVENTION

Figure 1:
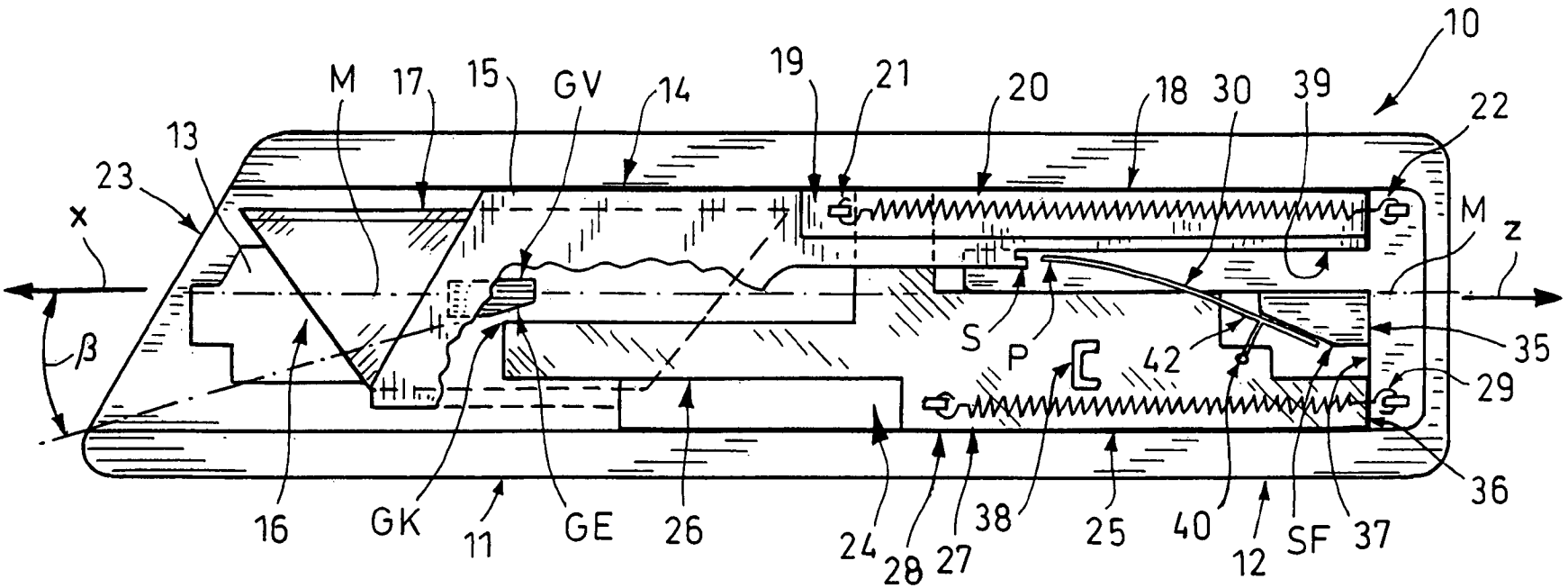
FIG. 1 is a side plan elevational view of one embodiment of the present invention with a portion of the housing removed and the blade in a retracted position.

In the drawings of the present invention an embodiment of the invention is shown in FIGS. 1-4 and 5-6.

In FIG.1, knife 10 is shown with only one shell half 12 of a casing or housing 11 of a knife 10, here a safety knife.

The casing half 12 has a longitudinally extending cavity 13 in which a blade holder 14 is displaceable in a straight line along a center axis M in a forward extension direction x and a rearward retraction direction z.

A front end 15 of the blade holder 14 holds a sheet-steel knife blade 16 here of trapezoidal shape. The blade 16 has a cutting edge 17.

A part of the front end 15 of the blade holder 14 is shown broken away so as to expose other parts of the knife 10. Immediately rearward in the direction z of the front end 15 of the blade holder 14 is a guide formation 18 defining a longitudinally extending slot 19 holding a tension spring 20. A front end 21 of the tension spring 20 is anchored on the blade holder 14 and a rear-end eye 22 is hooked on the casing shell 12. The tension spring 20 urges the blade holder 14 rearward in the retraction direction z in the knife casing 11.

The front end 15 of the blade holder 14 has a laterally projecting slide formation GV that defines a planar slide face GE that forms a small acute angle β with the extension direction x.

Inside the cavity 13 there is also an actuating slide 24 that can move longitudinally in the extension direction x and retraction direction z in the longitudinal cavity 13.

The actuating slide 24 has a rear end 25 and a front end 26, the latter with a front slide edge GK.

Another tension spring 27 has a front-end eye 28 hooked on the actuating slide 24 and a rear-end eye 29 anchored to the housing shell 11 at the rearward end portion of housing shell 11. The tension spring 27 urges the actuating slide 24 rearward in the retraction direction z.

The blade holder 14 and actuating slide 24 can move in parallel paths with a limited relative lateral play Q.

The rear end 25 of the actuator slide 24 also carries in the longitudinal cavity 13 a generally T-shaped part 30 that is formed of an elastically deformable material, in particular spring steel. The T-shaped part 30 has a center leg 31 seated in the rear end 25 of the actuating slide 24 at 40. The end of the leg 31 projecting from the rear end 25 of the actuating slide 24 meets a T-crosspiece 32 at an intersection 42. The part of the crosspiece 32 extending forward from the intersection 42 in the extension direction x is a coupling arm 33. The part of the crosspiece 32 extending rearward in the retraction direction z is a control arm 34 that coacts with a control face SF of a cam bump 35 that is formed on the casing shell 12.

Figure 3:
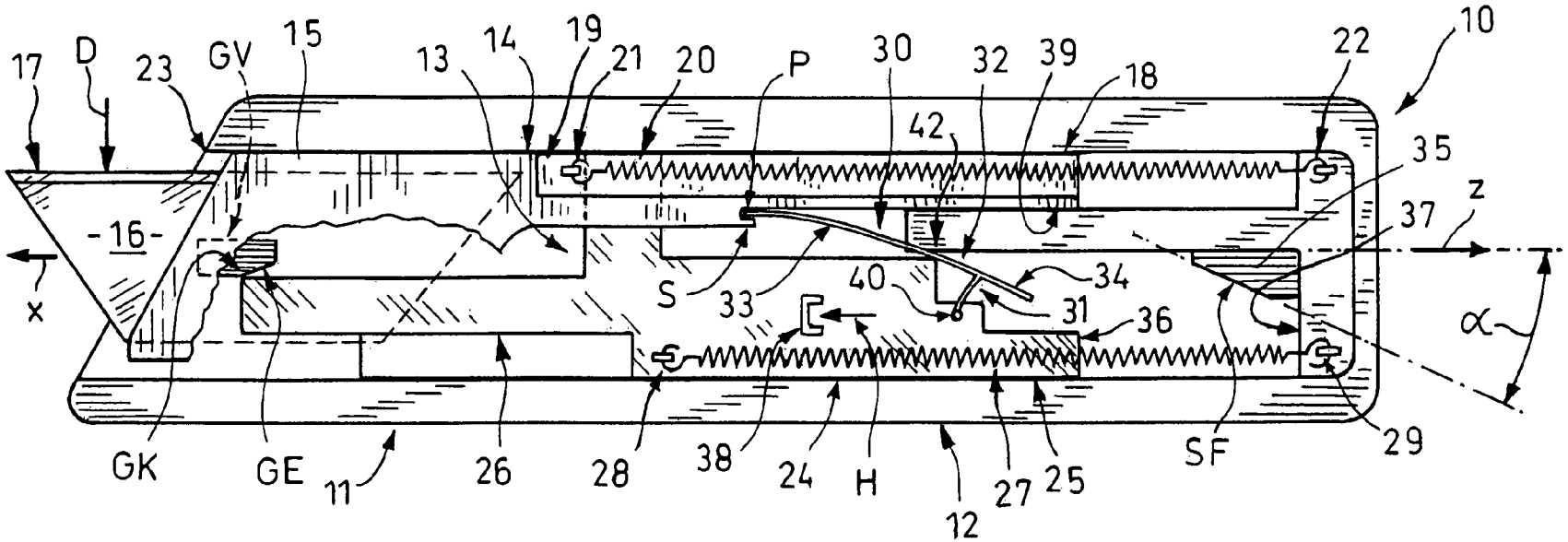
FIG. 3 is the view of the present invention of FIG. 2 with the actuator and blade holder moved further toward the forward end portion of the housing thereby positioning the blade in an extended working position.
Figure 4:
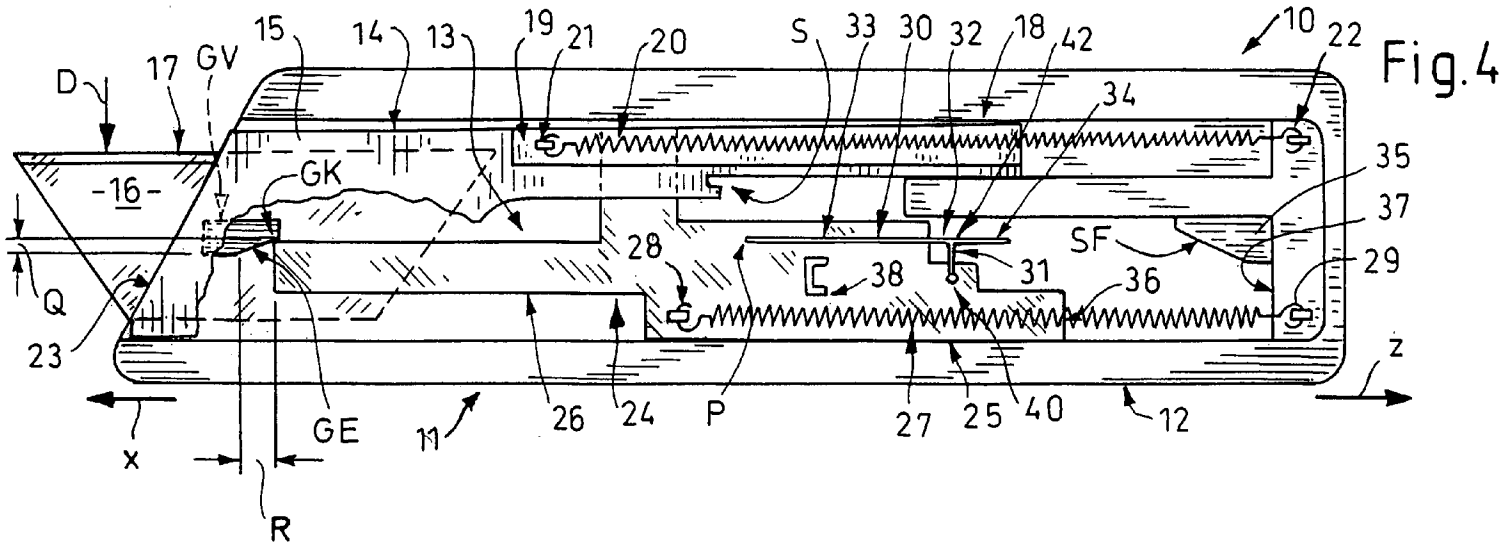
FIG. 4 is the view of the present invention of FIG. 3 with the blade receiving a force from a work piece, which results in the blade holder being displaced in two directions and the end of the coupling arm being removed from the contact it had with the blade holder.
Figure 5:
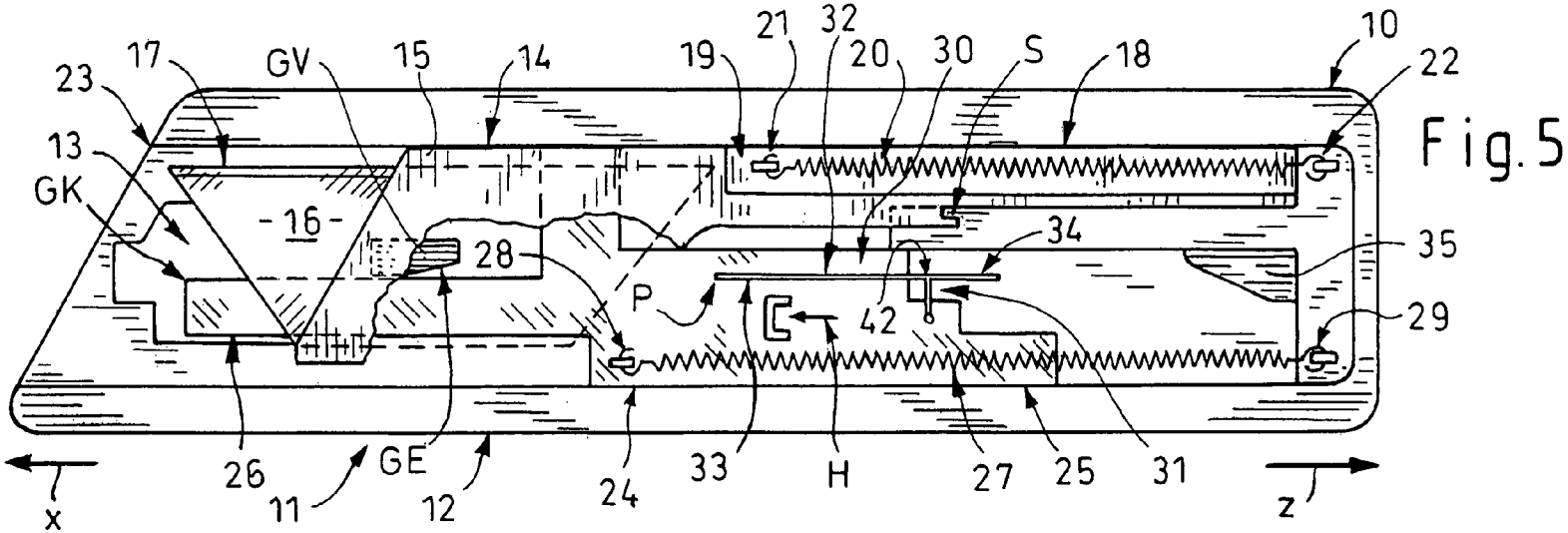
FIG. 5 is the view of the present invention of FIG. 4 wherein the blade holder retracts the blade toward the rearward end portion of the housing.
Figure 6:
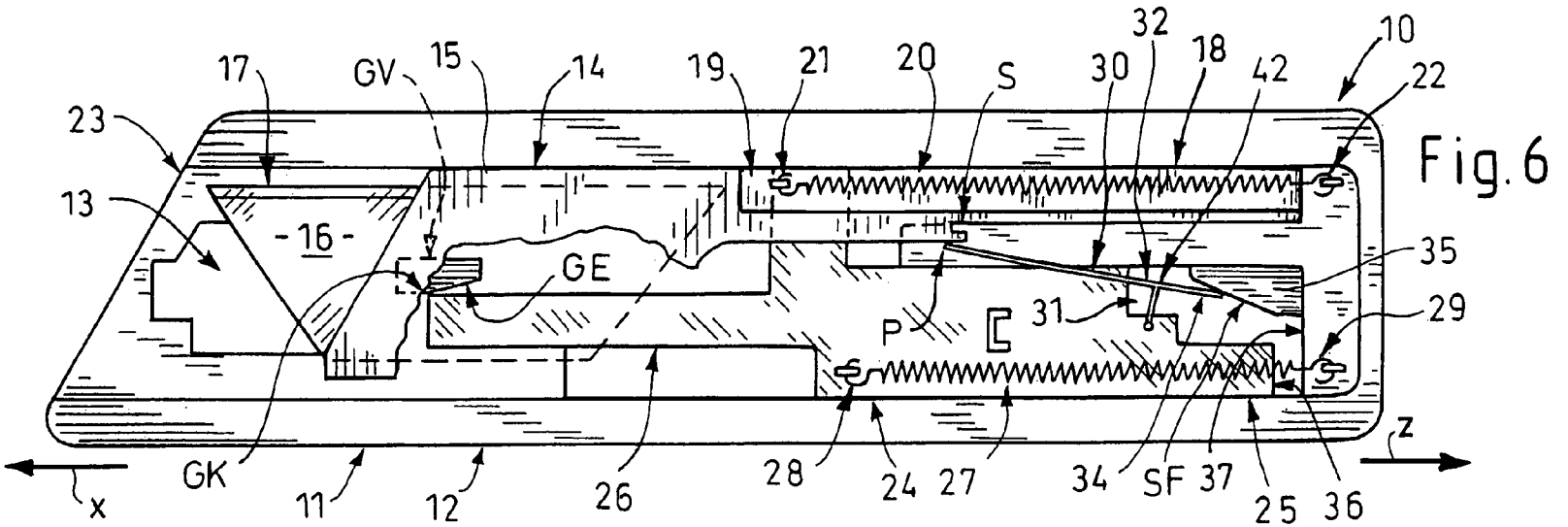
FIG. 6 is the view of the present invention of FIG. 5 wherein the actuator has moved closer toward the rearward end portion of the housing and the coupling arm is moved in a direction nonparallel to the direction of the length of the device for aligning the end of the coupling arm with the area of the contact as seen in FIG. 1 with the actuator in its fully retracted position.

The control face SF according to FIGS. 1-4 and to FIGS. 5 and 6 forms a slide face for the coupling arm 34 and defines a small acute angle alpha with the retraction direction z.

In this embodiment, mating coupling members comprise a front end of the coupling arm 33 which forms a primary coupling element P while a coupling opening (cutout) forms a recess open in the rearward retraction direction z of the blade holder 14 forms a secondary coupling element S.

The crosspiece 32 thus forms a two-arm lever that has the coupling arm 33 of the coupling element P extending forward in the extension direction x from a pivot formed by the center leg 31 and on the other side of the pivot the control arm 34 extending rearward in the retraction direction z.

The control arm 34 can engage the control face or surface SF when the actuating slide 24 is drawn in the retraction direction into a rear position. This pivots the crosspiece 32 such that the primary coupling element P moves out of a freeing position outside the path of the secondary coupling element S into a ready position engageable in the secondary coupling element S.

The knife 10 operates as follows:

In FIG. 1 the knife 10 is in a rest position. The tension spring 27 has pulled a rear end face 36 of the actuating slide 24 against an abutment face 37 of the casing shell 12. At the same time the primary coupling element P is spaced at a slight distance (in the ready position) from the secondary coupling element S.

Figure 2:
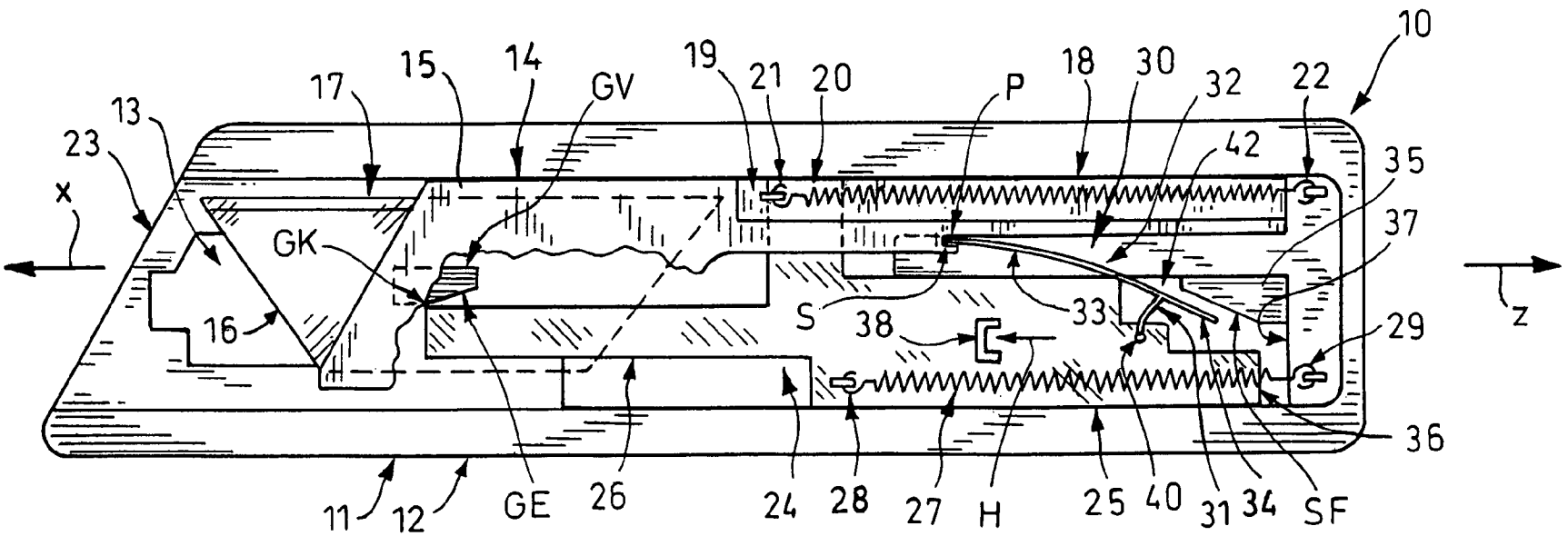
FIG. 2 is the view of the present invention of FIG. 1 with the actuator moved forward from the retracted position such that the end of the coupling member makes a contact with the blade holder.

As shown in FIG. 2 a manual force H is applied in the extension direction x to an actuating projection 38 so that the control arm 34 pulls out of contact with the control face SF. At the start of outward movement in the direction z the primary coupling element P fits into the secondary coupling element S since the control arm 34 as a result of the springiness of the T-shaped part 30 continues to bear on the control face SF. This holds the primary coupling element P aligned with the secondary coupling element S.

The manual force H effective in extension direction causes the control arm 34 to move off the control face SF so that as shown in FIG. 3 the knife blade 16 projects through a slot or opening 23 in the knife housing 11.

A comparison of FIGS. 2 and 3 shows that the slide edge GK of the control projection 26 during the entire travel in the direction x from the FIG. 2 position to the FIG. 3 position is below the slide plane or control surface GE of the slide projection or projection GV. FIG. 3 shows that the blade holder 14 and the blade 16 are not completely extended.

When as shown in FIG. 3 a cutting force D is applied, e.g. perpendicular to the edge 17 of the blade 16, the blade carrier 14 shifts downward as seen by comparing FIGS. 3 and 4 with its planar slide face GE along the slide edge GK through the transverse play Q and through a longitudinal offset R as shown in FIG. 4. This displacement of blade holder 14 relative to the actuating slide 24 separates the elements P and S from each other while leaving the actuating part 24 advanced in the direction x into a forward position.

In any of the positions moving from FIG. 1 and to FIG. 4 it is clear that the force converter GE/GK formed by the slide face or control surface GE and the slide edge GK is always effective independent of the extended or withdrawn position in the directions x or z, so long as there is a lateral force D which can of course also be angled to the blade edge 17.

It is therefore possible for the knife 10 in the position of FIG. 4 to cut until the blade 16 exits the workpiece, whereupon the blade 16 is no longer held by the workpiece and the spring 20 pulls back the blade holder 14 until the position of FIG. 5 is reached. Once the edge 17 of the blade 16 is disengaged from the unillustrated workpiece the spring 20 is effective and the blade holder 14 along with the blade 16 it is holding are pulled in the retraction direction z back into a protected position in the knife casing 11.

It is also possible with an unillustrated embodiment as a result of the separation of the coupling or decoupling between the elements P and S for the blade holder 14 with the blade 16 not to pull back in the retraction direction into the knife casing 11. Instead the potential energy of the tension spring stretched in the direction x can be used to extend a shield, for example a standard shield pin, parallel to the center axis along the blade edge 17 in order to reduce the likelihood of accidental cuts.

FIG. 5 also shows with manual force H remaining the same actuating slide element or actuator 24 remains in its position advanced in the direction x.

When the manual force H is removed, the position of FIG. 6 is assumed, with the slide edge GK back at the lower end of the slide face GE. The rear end face 36 of the actuating slide 24 is still spaced from the knife-housing abutment face 37. Meanwhile the primary coupling element P is below the secondary coupling element S while the end of the control arm 34 of the T-shaped part 30 touches the control face SF of the control cam 35. The part 30 starts to deform elastically. This makes the control arm 34 work on moving backward in the retraction direction z against an axial spring force while at the same time the coupling arm 33 moving in the retraction direction z passes with its primary coupling element P the secondary coupling element S.

Going from the position of FIG. 6 to that of FIG. 1 makes the tension spring 27 fully effective since the rear end face 36 of the actuating slide 24 bears against the casing abutment face 37. At the same time the control arm 34 of the T-shaped part 30 pushes with increasing force against the control face SF of the control cam 35 and bends the T-shaped part 30 so much that the coupling arm 33 of the crosspiece 32 bears against a lower longitudinal edge 39 of the guide projection 18 and thus sets the primary coupling element P in a ready position at a slight spacing forward of the secondary coupling element S.

Figure 4A:
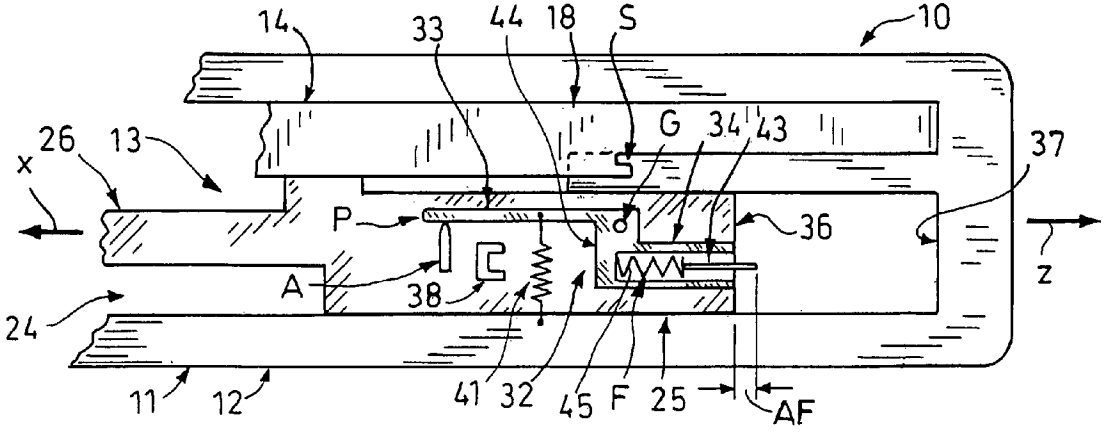
FIG. 4*a* is partially broken away view of another embodiment of the present invention as shown in FIG. 4.

FIG. 4A corresponds to the functional position shown in FIG. 4. Here the crosspiece 32 is differently shaped as shown in FIG. 4A, in that it is formed of two offset rigidly interconnected parts forming a Z, namely a rigid coupling arm 33, a central rigid connection bight 44, and a rigid control arm 34 projecting from the rigid bight 44.

The central bight 44 is mounted at a pivot G in the rear end of the actuating slide 24. The coupling arm 33 forming the primary coupling element P is biased downward by a spring 41 against a schematically illustrated abutment A. Otherwise the operation of the system of FIG. 4A is analogous to that of FIGS. 5, 6, and 1.

The embodiment according to FIG. 4A has the advantage that as a result of the rigidity of the crosspiece 32 larger forces can be transmitted via the slide part 24 in the direction x to the blade holder 14, serving for instance for stabbing the blade 16 into thick cardboard.

In any case the T-shaped part 30 according to FIGS. 1-6 as well as the rigid crosspiece 32 of FIG. 4A form a two-arm lever in the broadest sense, having a lever arm 33 (coupling arm) and a lever arm 34 (control arm). The pivot axis is either defined by the flexible leg 31 above its anchor point 40 (FIGS. 1-6) or by the pivot G (FIG. 4A).

A particular feature of the embodiment of FIG. 4A is that the control arm 34 holds a spring-loaded bumper 43 effective parallel to the two directions x and z and that can be pushed through a spring travel AF created by a compression spring F to be flush with a rear end face 37 of the rear end 25.

The embodiment of FIG. 4A functions as follows:

Once the cutting operation is completed and the edge 17 of the blade 16 has separated from the workpiece, the tension spring 20 pulls the blade holder 14 back into its retracted position as shown in the position of FIGS. 5 and 6. The tension springs 20 and 27 are for clarity's sake not shown in FIG. 4A but are the same as in FIGS. 1-6.

Shortly before the actuating slide 24 (see FIG. 6) shown in FIG. 4 reaches its retracted position (see FIG. 1), in which the end face 36 of the actuating slide 24 engages the casing abutment face 37, the free end of the spring bumper 43 engages the casing abutment face 37. It is clear that in this embodiment of FIG. 4A, abutment face 37 forms control face SF (not shown in FIG. 4A) such as shown in FIG. 4 wherein the control surface would be aligned to engage spring bumper 43 with retraction of actuator 24.

At the same time the primary coupling part P formed by the coupling arm 33 is swung upward against the guide extension 18 of the blade holder 14 and the bumper spring F in the control arm 34 is compressed until the spring bumper 43 is entirely in the control arm 34 and thus disappears in the rear end 25 of the actuating slide 24. During such inward travel of the spring bumper 43 the coupling arm 33 with its primary coupling element P travels also in the retraction direction z past the secondary coupling element S. This holds the coupling arm 33 in an upper pivoted position.

At the start of a subsequent outward movement of the actuating slide 24 in the direction x the bumper spring F extends somewhat. The bumper 43 projects to a certain extent from the control arm 34 and projects from the rear end 25 of the actuating slide 24 so that the primary coupling element P is shifted forward in the direction x out of its ready position (see FIG. 1) into the secondary element S (see FIG. 2) while the spring bumper 43 holds the coupling arm 33 in its upper pivoted position.

The invention claimed is:

1. A blade device, comprising:

an elongated housing wherein the housing comprises forward and rearward end portions and wherein the forward end portion defines an opening;

a blade holder moveable along a length of the housing toward the forward end portion;

an actuator moveable along the length of the housing toward the forward end portion wherein the actuator is associated with the blade holder to impart movement to the blade holder toward the forward end portion of the housing;

a projection secured to one of the blade holder and the actuator wherein the projection extends in a direction transverse to the length, wherein the projection comprises a control surface which extends in a direction nonparallel to the length, wherein the other of the actuator and the blade holder to which the projection is not secured contacts and moves along the control surface; and mating coupling members carried by the blade holder and the actuator, wherein the mating coupling members are coupled with the blade holder and the actuator moving toward the forward end portion of the housing.

2. The blade device of claim 1 further comprising a blade secured to the blade holder.

3. The blade device of claim 2 wherein the blade holder is moveable to a position along the length of the housing wherein the blade extends through the opening.

4. The blade device of claim 3 wherein the blade holder moves in the direction nonparallel to the length with a force applied to the blade with the blade extending beyond the opening.

5. The blade device of claim 1 wherein the blade holder is displaceable relative to the actuator in a direction along the length and in a direction perpendicular to the length.

6. The blade device of claim 1 wherein the coupling members include a coupling arm and a recess.

7. The blade device of claim 1 wherein the blade holder is movable in the direction nonparallel to the length and the mating coupling members decouple when the blade holder moves in the direction nonparallel to the length.

8. The blade device of claim 1 wherein the nonparallel direction and the length form an acute angle.

9. A blade device, comprising:

an elongated housing wherein the housing comprises forward and rearward end portions and wherein the forward end portion defines an opening;

a blade holder moveable along a length of the housing toward the forward end portion;

an actuator moveable along the length of the housing toward the forward end portion wherein the actuator is associated with the blade holder to impart movement to the blade holder toward the forward end portion of the housing;

a projection secured to one of the blade holder and the actuator wherein the projection extends in a direction transverse to the length, wherein the projection comprises a control surface which extends in a direction nonparallel to the length, wherein the other of the actuator and the blade holder to which the projection is not secured contacts the control surface such that the blade holder moves in the direction nonparallel to the length; and mating coupling members carried by the blade holder and the actuator wherein the mating coupling members are coupled with the blade holder and the actuator moving toward the forward end portion of the housing.

10. The blade device of claim 9 further comprising a blade secured to the blade holder.

11. The blade device of claim 10 wherein the blade holder is moveable to a position along the length of the housing wherein the blade extends through the opening.

12. The blade device of claim 11 wherein the blade holder moves in the direction nonparallel to the length with a force applied to the blade with the blade extending beyond the opening.

13. The blade device of claim 9 wherein the blade holder is displaceable relative to the actuator in a direction along the length and in a direction perpendicular to the length.

14. The blade device of claim 9 wherein the coupling members include a coupling arm and a recess.

15. The blade device of claim 9 wherein the blade holder is movable in the direction nonparallel to the length and the mating coupling members decouple when the blade holder moves in the direction nonparallel to the length.

16. The blade device of claim 9 wherein the nonparallel direction and the length form an acute angle.

* * * * *